US009172190B2

(12) United States Patent
Yoshimi et al.

(10) Patent No.: US 9,172,190 B2
(45) Date of Patent: Oct. 27, 2015

(54) CONNECTOR

(71) Applicants: Takanobu Yoshimi, Tokyo (JP); Masato Hida, Tokyo (JP); Takeki Fukazawa, Tokyo (JP); Kouta Ogura, Tokyo (JP)

(72) Inventors: Takanobu Yoshimi, Tokyo (JP); Masato Hida, Tokyo (JP); Takeki Fukazawa, Tokyo (JP); Kouta Ogura, Tokyo (JP)

(73) Assignee: DDK LTD., Tokyo (JP)

( * ) Notice: Subject to any disclaimer, the term of this patent is extended or adjusted under 35 U.S.C. 154(b) by 0 days.

(21) Appl. No.: 14/164,743

(22) Filed: Jan. 27, 2014

(65) Prior Publication Data

US 2014/0141645 A1 May 22, 2014

Related U.S. Application Data

(63) Continuation of application No. 13/232,177, filed on Sep. 14, 2011, now Pat. No. 8,672,697.

(30) Foreign Application Priority Data

Nov. 29, 2010 (JP) ..... 2010-264662

(51) Int. Cl.

| | |
|---|---|
| ***H01R 13/15*** | (2006.01) |
| ***H01R 13/62*** | (2006.01) |
| ***H01R 13/73*** | (2006.01) |
| ***H01R 13/629*** | (2006.01) |
| ***H01R 12/88*** | (2011.01) |
| ***H01R 12/77*** | (2011.01) |

(52) U.S. Cl.

CPC ..... *H01R 13/73* (2013.01); *H01R 12/774* (2013.01); *H01R 12/88* (2013.01); *H01R 13/62961* (2013.01)

(58) Field of Classification Search

CPC ..... H01R 12/774; H01R 12/88; H01R 13/62961; H01R 13/62938

USPC ..... 439/152, 153, 157, 159, 160, 260, 267, 439/329, 372, 923

See application file for complete search history.

(56) References Cited

U.S. PATENT DOCUMENTS

| | | | | |
|---|---|---|---|---|
| 4,875,867 | A | 10/1989 | Hoo | |
| 5,208,942 | A | 5/1993 | Simon | |
| 7,896,675 | B2 | 3/2011 | Hemmi et al. | |
| 8,672,697 | B2 * | 3/2014 | Yoshimi et al. | 439/153 |
| 2008/0305677 | A1 | 12/2008 | Koga | |

FOREIGN PATENT DOCUMENTS

| | | | |
|---|---|---|---|
| JP | 11-031561 | A | 2/1999 |
| JP | 2000-048886 | A | 2/2000 |
| JP | 2002-231348 | A | 8/2002 |
| JP | 2004-071160 | A | 3/2004 |
| JP | 2007-173043 | A | 7/2007 |
| KR | 10-2007-0068473 | A | 6/2007 |

* cited by examiner

*Primary Examiner* — Felix O Figueroa
(74) *Attorney, Agent, or Firm* — Dickstein Shapiro LLP

(57) ABSTRACT

A connector to be detachably fitted with a connecting object such as a flexible printed circuit board or flexible flat cable, includes a plurality of contacts each having a contact portion adapted to contact the connecting object, a housing arranging and holding therein the contacts and having a fitting opening into which the connecting object is inserted, and a pivoting member rotatably or pivotally mounted on the housing. According to the invention, an auxiliary member having an engaging unit for engaging the pivoting member is mounted on the pivoting member at its predetermined position. With the aid of the auxiliary member, the pivoting member can be easily rotated or pivotally moved.

6 Claims, 15 Drawing Sheets

CONNECTOR

This application is a continuation of U.S. application Ser. No. 13/232,177, filed on Sep. 14, 2011, the entire disclosure of which is incorporated herein by reference.

BACKGROUND OF THE INVENTION

This invention relates to a connector for use in communication systems such as mobile computers, projectors, televisions and the like, and other electric and electronic appliances, and more particularly to a connector having an auxiliary member which makes it easy to rotate or pivotally move a pivoting member of the connector even in a limited narrow space.

There have been connectors having a pivoting member which is pivotally moved to bring a connecting object such as a flexible printed circuit board or flexible flat cable into connection with the connector. Such a connector comprises at least a plurality of contacts, a housing, and a pivoting member. The connectors adapted to connect to a connecting object by a pivotal movement of the pivoting member are generally classified into a front lock type and a rear lock type. In the front lock type, the pivoting member is rotated on the side of a fitting opening of the connector into which the connecting object is inserted, while in the rear lock type, the pivoting member is rotated on the opposite side of the fitting opening of the connector.

As examples of connectors whose contacts are brought into contact with a connecting object by pivotally moving a pivoting member, incorporated herein are a connector of the rear lock type disclosed in Japanese Patent Application Opened No. H11-31,561 (1999) (Patent Literature 1), a connector of the rear lock type disclosed in Japanese Patent Application Opened No. 2004-71,160 filed by the applicant of the present case (Patent Literature 2), a connector of the rear lock type disclosed in Japanese Patent Application Opened No. 2007-173,043 filed by the applicant of the present case (Patent Literature 3), a connector of the front lock type disclosed in Japanese Patent Application Opened No. 2000-48,886 (Patent Literature 4), and a connector of the front lock type disclosed in Japanese Patent Application Opened No. 2002-231,348 filed by the applicant of the present case (Patent Literature 5).

Patent Literature 1

The invention of the Japanese Patent Application Opened No. H11-31,561 has an object to provide a connector superior in operability and capable of reliably connecting flat cables. Disclosed is a connector so constructed that when a pivoting member 4 provided at an opening 6 on the opposite side of an inserting opening 5 for flat wires 8 is at the starting position of the pivotal movement, a pushing portion 4*b* of the pivoting member 4 does not abut against peripheries of corners 3*a*2 of contact elements 3 so that the connector is under the opened condition in which the flat wires 8 are freely inserted or removed, and when the pivoting member 4 is being pivotally moved, the pushing portion 4*b* of the pivoting member 4 pushes the peripheries of corners 3*a*2 of the contact elements to cause them to be elastically deformed so that contact portions 3*a*1 are connected under pressure to the flat wires 8, and at the terminal position of the pivotal movement of the pivoting member 4, the pushing portion 4*b* of the pivoting member 4 rides over the apexes P2 of the corners 3*a*2 of the contact elements 3 to produce forces in directions maintaining the connection state by elastic restoring force of the contact elements 3.

Patent Literature 2

The invention in the Japanese Patent Application Opened No. 2004-71,160 has an object to provide a connector capable of securely pushing a flexible printed circuit board 40 or flexible flat cable to contact portions 22 of contacts 14 by means of a slider 16 without detracting from strength of respective members and specifications or customer's demands, and achieving a superior operability, extremely smaller pitches of conductors and reduced overall height. Disclosed is a connector particularly achieving the reduced overall height of this object of the invention in that the connector comprises contacts 14 each comprising a contact portion 22, a connection portion 24, and an elastic portion 34 and a fulcrum portion 32 between the contact portion 22 and the connection portion 24, and a pressure receiving portion 20 extending from the elastic portion 34 in a position facing to the connection portion 24, and the contact portion 22, the elastic portion 34, the fulcrum portion 32 and the connection portion 24 being arranged in the form of a crank, and a slider 16 comprising pushing portions 36 provided continuously in the longitudinal direction and the slider 16 being pivotally mounted on a housing 12 so that the pushing portions 36 are pivotally moved in spaces between the connection portions 22 and the pressure receiving portions 20 of the contacts 14.

Patent Literature 3

The invention in the Japanese Patent Application Opened No. 2007-173,043 has an object to provide a connector 10 performing a stable connection with a connecting object, while considering acoustical technology and a reduced overall height of the connector. In a connector 10 to be detachably fitted with a connecting object, comprising a required number of contacts 14 each having a contact portion 26 adapted to contact the connecting object, a housing 12 holding and fixing the contacts 14 therein and having a fitting opening 20 into which the connecting object is inserted, and a pivoting member 18 for pushing the contacts 14, there is provided a shell 19 to cover the housing 12 provided with a ceiling portion 50 covering and insulating the contact portions 26 of the contacts 14, and the pivoting member 18 is provided with a projecting wall 60 extending in parallel with the ceiling portion 50 of the housing 12 so that when the pivoting member 18 is opened (when the connecting object is not inserted into the housing) the projecting wall 60 engages the upper surface 74 of the shell 60.

Patent Literature 4

The invention in Japanese Patent Application Opened No. 2000-48,886 has an object to provide an electrical connector for a flexible printed circuit board, having a construction not impeding a reduced overall height of the connector and enabling a smaller mounting area of the connector mounted on a printed circuit substrate. The electrical connector for a flexible printed circuit board comprises an insulating housing 3, a plurality of terminals 4 arranged in the insulating housing 3 in the transverse direction in parallel with one another with a predetermined pitch, and a pivoting cover 2 having a pushing portion for pushing the flexible printed circuit board against contact portions 17*a* of the terminals 4. The pivoting cover 2 is supported on the insulating housing 3 to be pivotally moved relatively to the insulating housing 3 on the side of an inserting opening 5 for the flexible printed circuit board, and when the pivoting cover 2 is pivotally moving, the deep portion 6 of the pivoting cover 2 positioned in the deeper portion of the housing 3 than the mounted portion of the pivoting cover 2 mounted on the housing 3 is moved along a circular path above the insulating housing 3 as viewed from the side of the inserting opening 5 for the flexible printed circuit board. In this manner, the pivoting cover 2 is pivotally movable in the width zone of the insulating housing 3 extending from the side of said inserting opening 5 to the deep portion 6.

Patent Literature 5

The invention in the Japanese Patent Application Opened No. 2002-231,348 has an object to provide a connector capable of securely pushing a flexible printed circuit board 42 or flexible flat cable against contact portions 20 of contacts 14 by means of a slider 16, thereby completely avoiding the connection failure. In a connector detachably fitted with a flexible printed circuit board 42 or flexible flat cable, comprising contacts 14 each having a contact portion 20 adapted to contact the flexible printed circuit board 42 or flexible flat cable, a block 12 for holding and fixing the contacts 14, and a slider 16 pivotally movably mounted on the block 12, the slider 16 comprises pushing portions 32 adapted to push the flexible printed circuit board 42 or flexible flat cable upon pivotal movement of the slider 16, and the pushing portions 32 are adapted to be constrained by the block 12 or the contacts 14 so as to prevent the pushing portions 32 from displacing in the directions opposite from their pushing directions when pushing the flexible printed circuit board 42 or flexible flat cable.

Recently, the trend in electric and electronic appliances, particularly communication appliances has been toward increasingly smaller geometries. With such a trend, the miniaturization of connectors has also progressed. Under these circumstances, connectors are often constructed that when a pivoting member has been pivotally moved into a locked condition, the height of the connector is substantially equal to that of a housing. As a result, it becomes very difficult to operate the pivoting member so as to be pivotally moved. Moreover, the connector of this kind is installed in an appliance for may cases so that it becomes difficult to obtain a sufficient space for pivotally moving the pivoting member, resulting in a poor operability.

Further, even if a space can be obtained, the difficulty remains in operating the pivoting member because the connector lies in the appliance. The problems noted herein have not been solved in the connectors of front and rear lock types disclosed in the above Patent Literatures 1-5.

SUMMARY OF THE INVENTION

The invention has been completed in view of the problems with the prior art, and the invention has an object to provide a connector having an auxiliary member which makes it possible for a pivoting member to be easily pivotally moved.

The object of the invention can be achieved by the connector to be detachably fitted with a connecting object according to the invention, including a plurality of contacts each having a contact portion adapted to contact the connecting object, a housing arranging and holding therein the contacts and having a fitting opening into which the connecting object is inserted, and a pivoting member rotatably mounted on the housing, wherein an auxiliary member having engaging means for engaging the pivoting member is mounted on the pivoting member at its predetermined position.

In a preferred embodiment of the invention, the engaging means comprises an engaging portion provided on the auxiliary member and an anchoring portion provided on the pivoting member.

In a more preferred embodiment of the invention, the anchoring portion comprises a recessed portion formed in the pivoting member, while the engaging portion comprises a protrusion formed in the auxiliary member and adapted to be fitted in the recessed portion of the pivoting member and a groove portion formed in the auxiliary member and adapted to receive a ridge of the pivoting member.

It is preferable to provide a guide at least at one longitudinal end of the protrusion and the groove portion of the auxiliary member.

In a preferred embodiment of the invention, the pivoting member is rotatably mounted on the housing on the side opposite from the fitting opening, and the contacts are at least either kind of contacts selected from two kinds of contacts. The first contacts of the one kind each comprise at least a first contact portion, a first connection portion, a first elastic portion and a first fulcrum portion between the first contact portion and the first connection portion, and a first pressure receiving portion extending from the first elastic portion in a position facing to the first connection portion. The first contact portion, the first elastic portion, the first fulcrum portion, and the connection portion are arranged in the form of a crank. The second contacts of the other kind each comprise at least a second contact portion, a second connection portion, a second elastic portion and a second fulcrum portion between the second contact portion and the second connection portion, and a second pressure receiving portion extending from the second elastic portion in a direction opposite from the second contact portion. The second contact portion, the second elastic portion, the second fulcrum portion, and the second connection portion are arranged in the form of a U-shape.

In the above embodiment according to the invention, the pivoting member is rotatably mounted on the housing on the side opposite from the fitting opening, and the pivoting member is provided with pushing portions of an elongated shape continuously arranged in the longitudinal direction of the pivoting member and adapted to act on the first pressure receiving portions and/or the second pressure receiving portions, and the pivoting member is further provided with anchoring holes independent from one another having partitions to permit the first pressure receiving portions and/or the second pressure receiving portions to be received in the anchoring holes, thereby connecting the connector to the connecting object by the action of the pushing portions on the first pressure receiving portions and/or the second pressure receiving portions.

In a more preferred embodiment of the invention, the pivoting member is rotatably mounted on the housing on the side of the fitting opening, and the contacts each comprise at least a contact portion adapted to contact the connecting object, a connection portion to be connected to a substrate, a fixed portion to be fixed in the housing, and an engaging portion to engage the pivoting member. The pivoting member is provided with pushing portions continuously arranged in the longitudinal direction of the pivoting member and anchoring holes independent from one another having partitions to permit the engaging portions to be received in the anchoring holes, whereby when the engaging portions engage the anchoring holes and the pivoting member is pivotally moved, the pushing portions push the connecting object to bring it into contact with the contact portions of the contacts.

According to the particular embodiment of the invention, the pivoting member is rotatably mounted on the housing on the side of the fitting opening, and the contacts each comprise at least a contact portion adapted to contact the connecting object, and a connection portion to be connected to a substrate. A member separate from the contacts is provided, which has at least an engaging portion adapted to engage the pivoting member, and the pivoting member is provided with pushing portions continuously arranged in the longitudinal direction of the pivoting member and anchoring holes independent from one another having partitions to permit the engaging portions to be received in the anchoring holes, whereby when the engaging portions engage the anchoring holes and the pivoting member is pivotally moved, the pushing portions push the connecting object to bring it into contact with the contact portions of the contacts.

As can be seen from the above description, the connector according to the invention can bring about the following significant functions and effects. With the connector according to the invention, the pivoting member can be easily rotated even if in a limited narrow space.

(1) In a connector to be detachably fitted with a connecting object, including a plurality of contacts each having a contact portion adapted to contact the connecting object, a housing arranging and holding therein the contacts and having a fitting opening into which the connecting object is inserted, and a pivoting member rotatably mounted on the housing, according to the invention an auxiliary member having engaging means for engaging the pivoting member is mounted on the pivoting member at its predetermined position. Therefore, the connector has a simple construction and is superior in operability, and its pivoting member can be easily rotated even in a limited narrow space.

(2) In a preferred embodiment of the invention, the engaging means comprises an engaging portion provided on the auxiliary member and an anchoring portion provided on the pivoting member. Accordingly, the connector has a simple construction and is superior in operability, and its pivoting member can be easily rotated even in a limited narrow space.

(3) In a more preferred embodiment of the invention, the anchoring portion comprises a recessed portion formed in the pivoting member, while the engaging portion comprises a protrusion formed in the auxiliary member and adapted to be fitted in the recessed portion of the pivoting member and a groove portion formed in the auxiliary member and adapted to receive a ridge of the pivoting member. With such a configuration, the connector has a simple construction and is superior in operability, and its pivoting member can be easily rotated even in a limited narrow space.

(4) Preferably, a guide is provided at least at one longitudinal end of the protrusion and the groove portion of the auxiliary member. Therefore, the connector has a simple construction and is superior in operability, and its pivoting member can be easily rotated even in a limited narrow space. Further, the auxiliary member can be mounted on the pivoting member in a simple manner.

(5) In a preferred embodiment of the invention, the pivoting member is rotatably mounted on the housing on the side opposite from the fitting opening, and the contacts are at least either kind of contacts selected from two kinds of contacts. The first contacts of the one kind each comprise at least a first contact portion, a first connection portion, a first elastic portion and a first fulcrum portion between the first contact portion and the first connection portion, and a first pressure receiving portion extending from the first elastic portion in a position facing to the first connection portion. The first contact portion, the first elastic portion, the first fulcrum portion, and the connection portion are arranged in the form of a crank. The second contacts of the other kind each comprise at least a second contact portion, a second connection portion, a second elastic portion and a second fulcrum portion between the second contact portion and the second connection portion, and a second pressure receiving portion extending from the second elastic portion in a direction opposite from the second contact portion. The second contact portion, the second elastic portion, the second fulcrum portion, and the second connection portion are arranged in the form of a U-shape. Accordingly, even with a connector of the rear lock type whose pivoting member is located more inwardly in an appliance, the connector is superior in operability with a simple construction, and its pivoting member can be easily rotated even in a limited narrow space. Further, the auxiliary member can be mounted on the pivoting member in a simple manner.

(6) In the above embodiment according to the invention, the pivoting member is rotatably mounted on the housing on the side opposite from the fitting opening, and the pivoting member is provided with pushing portions of an elongated shape continuously arranged in the longitudinal direction of the pivoting member and adapted to act on the first pressure receiving portions and/or the second pressure receiving portions, and the pivoting member is further provided with anchoring holes independent from one another having partitions to permit the first pressure receiving portions and/or the second pressure receiving portions to be received in the anchoring holes, thereby connecting the connector to the connecting object by the action of the pushing portions on the first pressure receiving portions and/or the second pressure receiving portions. Therefore, even with a connector of the rear lock type whose pivoting member is located more inwardly in an appliance, the connector is superior in operability with a simple construction, and its pivoting member can be easily rotated even in a limited narrow space. Further, the auxiliary member can be mounted on the pivoting member in a simple manner.

(7) In a more preferred embodiment of the invention, the pivoting member is rotatably mounted on the housing on the side of the fitting opening, and the contacts each comprise at least a contact portion adapted to contact the connecting object, a connection portion to be connected to a substrate, a fixed portion to be fixed in the housing, and an engaging portion to engage the pivoting member. The pivoting member is provided with pushing portions continuously arranged in the longitudinal direction of the pivoting member and anchoring holes independent from one another having partitions to permit the engaging portions to be received in the anchoring holes, whereby when the engaging portions engage the anchoring holes and the pivoting member is pivotally moved, the pushing portions push the connecting object to bring it into contact with the contact portions of the contacts. With such a construction, even with a connector whose pivoting member is located more inwardly in an appliance, the connector is superior in operability with a simple construction, and its pivoting member can be easily rotated even in a limited narrow space. Further, the auxiliary member can be mounted on the pivoting member in a simple manner.

(8) According to the particular embodiment of the invention, the pivoting member is rotatably mounted on the housing on the side of the fitting opening, and the contacts each comprise at least a contact portion adapted to contact the connecting object, and a connection portion to be connected to a substrate. A member separate from the contacts is provided, which has at least an engaging portion adapted to engage the pivoting member, and the pivoting member is provided with pushing portions continuously arranged in the longitudinal direction of the pivoting member and anchoring holes independent from one another having partitions to permit the engaging portions to be received in the anchoring holes, whereby when the engaging portions engage the anchoring holes and the pivoting member is pivotally moved, the pushing portions push the connecting object to bring it into contact with the contact portions of the contacts. Therefore, even with a connector whose pivoting member is located more inwardly in an appliance, the connector is superior in operability with a simple construction, and its pivoting member can be easily rotated even in a limited narrow space. Further, the auxiliary member can be mounted on the pivoting member in a simple manner.

The invention will be more fully understood by referring to the following detailed specification and claims taken in connection with the appended drawings.

DESCRIPTION OF THE PREFERRED EMBODIMENTS

Figure 1A:
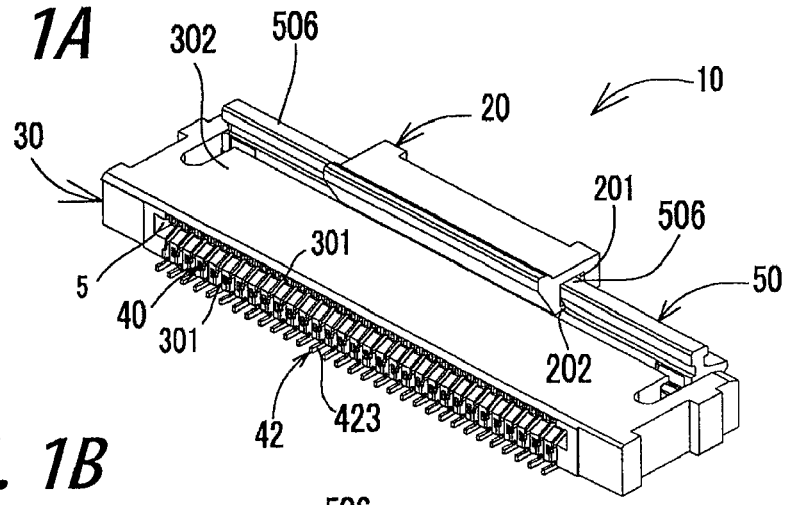
FIG. 1A is a perspective view of a connector according to the invention with an auxiliary member mounted on a pivoting member in an opened condition viewed from the above a fitting opening.
Figure 1B:
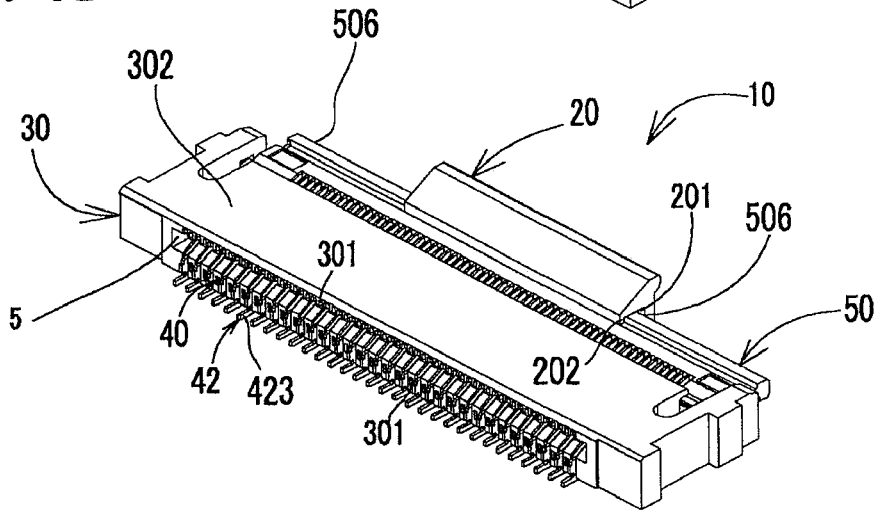
FIG. 1B is a perspective view of the connector with the auxiliary member mounted on the pivoting member in a closed condition viewed from the above the connector.
Figure 1C:
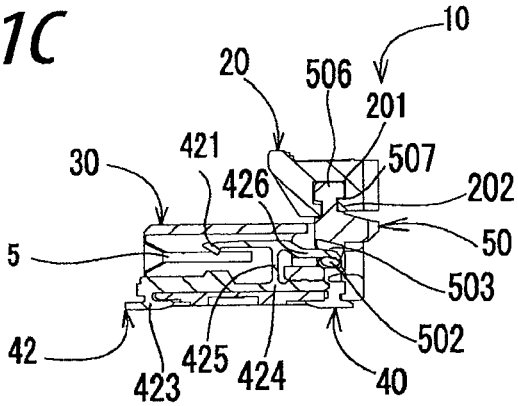
FIG. 1C is a cross-sectional view of the connector shown in FIG. 1A taken along its center.
Figure 2A:
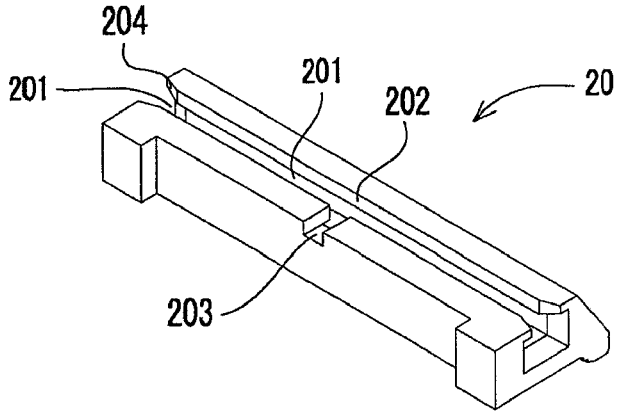
FIG. 2A is a perspective view of the auxiliary member viewed from the side on which it is attached to the pivoting member.
Figure 2B:
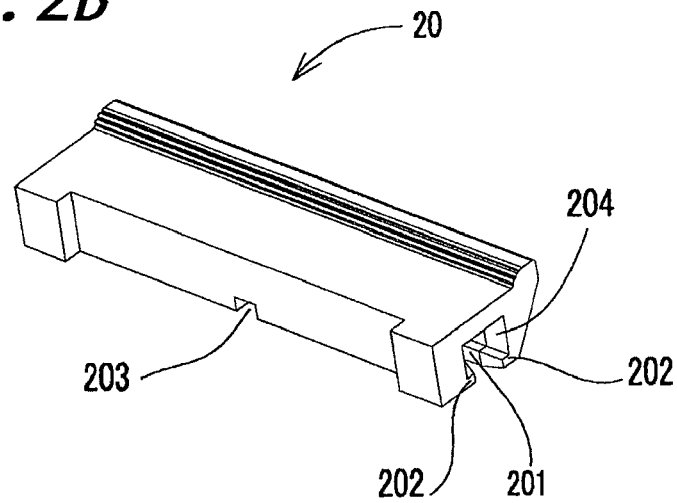
FIG. 2B is a perspective view of the auxiliary member shown in FIG. 2A viewed from the opposite side.
Figure 2C:
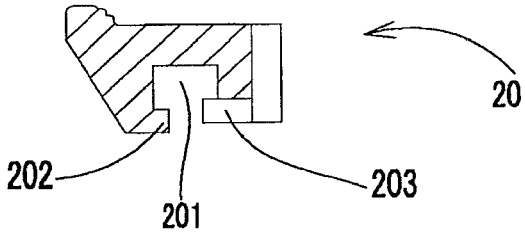
FIG. 2C is a cross-sectional view of the auxiliary member shown in FIG. 2B taken along its center.
Figure 3A:
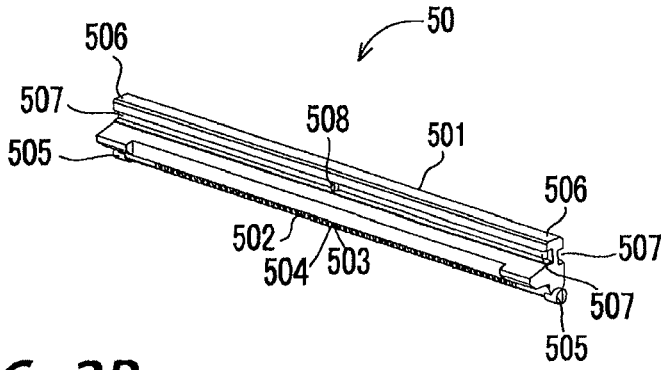
FIG. 3A is a perspective view of the pivoting member shown in FIG. 1A.
Figure 3B:
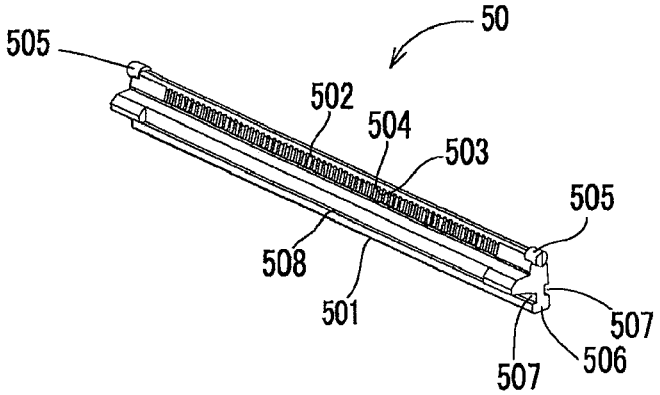
FIG. 3B is a perspective view of the pivoting member shown in FIG. 3A turned upside down.
Figure 3C:
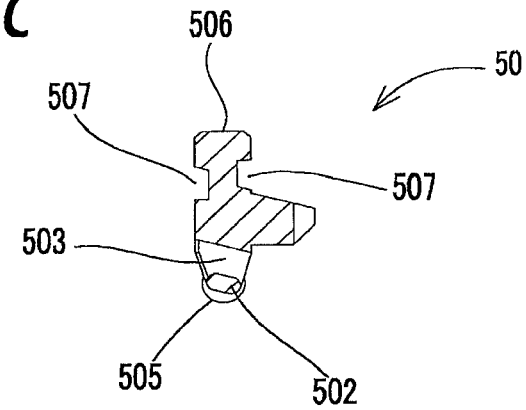
FIG. 3C is a cross-sectional view of the pivoting member shown in FIG. 3A.

The embodiments of the invention will then be described with reference to the attached drawings. Forming the important aspect of the invention is the connector to be detachably fitted with a connecting object, including a plurality of contacts each having a contact portion adapted to contact the connecting object, a housing arranging and holding therein the contacts and having a fitting opening into which the connecting object is inserted, and a pivoting member rotatably mounted on the housing, wherein an auxiliary member having engaging means for engaging the pivoting member is mounted on the pivoting member at its predetermined position. The words "predetermined position" are here understood as signifying a position enabling the easy pivotal movement of the pivoting member by merely pushing the auxiliary member. Such a position is ideally at the center of the pivoting member in its longitudinal direction in consideration of balancing and the like. In other words, the connector having the pivoting member is provided with the auxiliary member for making the pivotal movement of the pivoting member easy.

First, the auxiliary members 20, 21 and 22 which form very important aspect of the invention will be explained with reference to FIGS. 2A to 2C, 7A to 7C and 12A to 12C. The auxiliary member 20 is used for a rear lock type connector, and the auxiliary member 21 is also used for a rear lock type connector having a more reduced overall height than that of the connector using the auxiliary member 20, while the auxiliary member 22 is used for a front lock type connector. Said auxiliary members 20, 21 and 22 are formed from an electrically insulating plastic material by means of the injection molding of the known technique. The materials for the auxiliary members may be suitably selected in consideration of dimensional stability, workability, manufacturing cost, and the like, and such materials are generally polybutylene terephthalate (PBT), polyamide (66PA or 46PA), liquid crystal polymer (LCP), polycarbonate (PC), and the like and combination thereof.

Each of the auxiliary members 20, 21 and 22 has engaging means for mounting the auxiliary member on a pivoting member 50, 51 and 52. The engaging means comprises an engaging portion provided on the auxiliary member 20, 21 and 22 and anchoring portion provided on the pivoting member 50, 51 and 52. Each of said pivoting member 50, 51 and 52 may be formed with recessed portions 507, 517 and 527 as said anchoring portion, while said auxiliary member 20, 21 and 22 may be formed with protrusions 202, 212 and 222 adapted to be received in said recessed portions 507, 517 and 527 and a groove portion 201, 211 and 221 for receiving therein a ridge or tip 506, 516 and 526 of said pivoting member 50, 51 and 52. Shapes and sizes of said protrusions 202, 212 and 222 may be any ones so long as they are able to be received in said recessed portions 507, 517 and 527, respectively, and may be suitably designed in consideration of holding force, strength, workability, and the like. Shapes and sizes of said groove portions 201, 211 and 221 may also be any ones insofar as they are able to receive therein the ridges or tips 506, 516 and 526 of said pivoting members, respectively, and may be suitably designed taking into account the holding force, strength, workability, and the like.

With the construction described above, the auxiliary member may be moved relative to the pivoting member in its longitudinal direction for mounting the auxiliary member on the pivoting member. As another means there is a snap-engaging means (not shown) in which the auxiliary member is pushed to the pivoting member in its transverse direction, which is not longitudinal direction, so that a projection provided on said auxiliary member snaps into an engaging portion provided in said pivoting member, thereby securely holding together these members. Shapes and sizes of the relevant portions of the members may be designed so as to achieve the above function and in consideration of the strength, workability, and the like.

Said auxiliary member 20, 21 and 22 is formed with a guide 204, 214 and 224 at least at one end of the protrusions 202, 212 and 222 or the grooved portion 201, 211 and 221. The guides 204, 214 and 224 are formed as chamfers or obliquely faces as shown in the drawings for facilitating the insertion of the auxiliary member 20, 21 and 22 into the pivoting member 50, 51 and 52. Shapes and sizes of the guides 204, 214 and 224 may be any ones so long as they can facilitate the mounting of the auxiliary member on the pivoting member and suitably designed taking into account the function, workability and the like.

Said auxiliary member 20, 21 and 22 is formed at its center with a recess 203, 213 and 223. Said recesses 203 and 223 are adapted to engage projections 508 and 528 of said pivoting member 50 and 52 to position the auxiliary members 20 and 22 relative to the pivoting members 50 and 52, respectively. In the embodiment shown in FIGS. 7A to 7C, the auxiliary member 21 is formed with the recess 213, while the pivoting member 51 is not provided with a projection. However, it is desirable to provide the projection on the pivoting member 51 from the standpoint of positioning of the auxiliary member. Shapes and sizes of said recesses 203, 213 and 223 may be any ones insofar as they can engage the projections 508 and 528 of said pivoting members 50 and 52, respectively, and suitably designed in consideration of the function, strength, workability, and the like.

One embodiment of the rear lock type connector 10 will be explained with reference to FIGS. 1A to 5B. The auxiliary member 20 used herein has already been described above. Other configurations will be explained hereinafter.

First, the pivoting member 50 will be described. The pivoting member 50 is formed from an electrically insulating plastic material by means of the injection molding of the known technique. The materials for the pivoting member may be suitably selected in consideration of dimensional stability, workability, manufacturing cost, and the like, and such materials are generally polybutylene terephthalate (PBT), polyamide (66PA or 46PA), liquid crystal polymer (LCP), polycarbonate (PC), and the like and combination thereof.

Said pivoting member 50 mainly comprises axles 505 to be fitted in the housing 30 for pivotally moving the pivoting member 50, pushing portions 502 adapted to act on or push pressure receiving portions 406 and 426 of first and second contacts 40 and 42, anchoring holes 503 formed individually independently from one another by means of partitions 504 located between the anchoring holes 503 for receiving therein the pressure receiving portions 406 and 426 of said first and second contacts 40 and 42, and an actuating portion 501 for actuating the pivoting member 50. In the embodiment, the pivoting member further comprises a ridge or tip 506 to be received in the groove portion 201 of said auxiliary member 20, recessed portions 507 for receiving therein said protrusions 202, and a projection 508 adapted to engage said recess 203.

The pivoting member 50 has a substantially cruciform cross-section in this embodiment. Said axles 505 form a fulcrum of the pivotal movement of the pivoting member 50 and are rotatably supported in the longitudinal ends of the housing 30. Moreover, said axles 505 are not tightly fitted in the bearing holes of the housing 30, but are loosely fitted in the bearing holes of the housing with some clearances so that upon the pivoting member 50 being pivotally moved, the position of the pivotal axis varies owing to the clearances of the bearing holes around the axles 505. The pivoting member 50 is further provided at both the longitudinal ends thereof with locking portions adapted to engage the housing 30 for preventing the pivoting member 50 from being raised upwardly when said pushing portions 502 are acting on the first and second pressure receiving portions 406 and 426 of the first and second contacts 40 and 42. Shapes and sizes of the locking portions may be any ones so long as they are able to engage said housing 30 and are suitably designed taking into account the function, the size and strength of the connector 10, and the like. In the present embodiment, the pivoting member 50 has protruding bases continuously provided on the side of first connection portions 403 facing to pressure receiving portions of said first contacts.

The pushing portions 502 of said pivoting member 50 serve to push the pressure receiving portion 406 or 426 of said first or second contact 40 or 42, and their shape is preferably an elongated shaped, particularly elliptical in the illustrated embodiment. With such an elliptical shape, when the pivoting member 50 is pivotally moved so as to act on or push the first and second pressure receiving portions 406 and 426 of the first and second contacts 40 and 42, the first and second pressure receiving portions 406 and 426 are moved upwardly with the aid of variation in contact height owing to the elliptical shape of the pushing portions 502, thereby pushing the first and second contact portions 401 and 421 of the first and second contacts 40 and 42 against the flexible printed circuit board. The pushing portions 502 may be formed in any shape insofar as they can be rotated so as to act on the first and second pressure receiving portions 406 and 426 of the first and second contacts 40 and 42, and the first and second pressure receiving portions 406 and 426 of the first and second contacts 40 and 42 can be raised with the aid of the variation in contact height owing to, for example, difference in major and minor axes of an ellipse. The shape and size of the pushing portions 502 may be suitably designed in consideration of these functions. Said pivoting member 50 is further provided with an actuating portion 501 for improving its operability.

Said pivoting member 50 is provided with the ridge or tip 506 having a size to be received in the groove portion 201 of said auxiliary member 20. Said pivoting member 50 is further formed with recessed portions 507 into which the protrusions 202 of said auxiliary member 20 are fitted. The ridge or tip 506 and the recessed portions 507 form means for causing the auxiliary member 20 to engage with the pivoting member 50. In this embodiment, the pivoting member 50 has the two recessed portions 507 one on each side of it as shown in the drawing, but the pivoting member 50 may have only one recessed portion 507. In this case, the auxiliary member also has only one protrusion 202. Shapes and sizes of said ridge or tip 506 and said recessed portions 507 may be any ones so long as the ridge or tip 506 is fitted in the groove portion 201 of said auxiliary member 20 and the recessed portions 507 receive the protrusions 202, and may be suitably designed taking into account their functions, strength, workability, and the like. The recessed portions 507 extend linearly in the longitudinal direction of the pivoting member 50 in the illustrated embodiment, and may have a U-shaped or C-shaped cross-section insofar as their functions can be achieved.

Said pivoting member 50 is further provided at its center with the projection 508 adapted to engage the recess 203 formed in said auxiliary member 20, thereby holding and positioning the auxiliary member 20 relatively to the pivoting member 50. The shape and size of said projection 508 may be any ones so long as it can engage the recess 203 of the auxiliary member 20, and suitably designed in consideration of the function, holding force, strength, workability, and the like.

When the pivoting member 50 is pivotally moved, the pivoting member 50 itself tends to be deformed by reaction forces against the pivotal movement. In order to prevent such a deformation, the pivoting member 50 is formed with anchoring holes 503 for receiving the first and second pressure receiving portions 406 and 426 of the first and second contacts 40 and 42. The anchoring holes 503 are independent from one another with the aid of partitions located between the anchoring holes. The prevention of deformation of the pivoting member will be explained in more detail in the later description of the contacts. The anchoring holes 503 provided independently from one another serve to maintain the strength of the pivoting member 50 with the aid of the partitions located therebetween and prevent it from being deformed when pivotally moving. The pivoting member 50 described above is pivotally mounted on the housing on the opposite side of its fitting opening 5, that is, on the side of the connection portions of the first contacts 40.

The first and second contacts 40 and 42 of the two kinds will then be explained with reference to FIGS. 5A and 5B. The first and second contacts 40 and 42 are made of a metal and formed by means of the press-working of the known technique. Preferred metals from which to form the first and second contacts 40 and 42 include brass, beryllium copper, phosphor bronze and like which comply with the requirements as to springiness, electric conductivity, and the like.

Initially, the first contact 40 shown in FIG. 5A will be described. The first contact 40 in the embodiment is substantially H-shaped as shown in FIG. 5A, and comprises at least a first contact portion 401 (positioned at the upper portion of the contact shown in FIG. 5A) adapted to contact a flexible printed circuit board, a first connection portion 403 to be connected to a substrate or the like, a first fixed portion 402 to be fixed to the housing 30, a first fulcrum portion 404, a first elastic portion 405, and a first pressure receiving portion 406 adapted to be pushed by the pivoting member 50. The first pressure receiving portion 406 is provided at its one end with a projection projecting inwardly or downwardly as viewed in FIG. 5A. Said first contact portion 401, said first elastic portion 405, said first fulcrum portion 404 and said first connection portion 403 are arranged substantially in the form of a crank. The first connection portion 403 is provided with a protruding base protruding toward the first pressure receiving portion 406 so that when the pivoting member 50 is pivotally moving, the pushing portions 502 act upon the first pressure receiving portions 406 of the first contacts 40. In the shown embodiment, the first contact 40 is formed with an inclined portion in the proximity of the fulcrum portion 404, which is inclined downwardly toward the fitting opening 5 of the housing 30, thereby contributing to the reduced overall height of the connector. The protruding base described above serves to adjust the distance between the first pressure receiving portion 406 and the first connection portion 403 in order to achieve a stable pivoting movement of the pivoting member 50 with the pushing portions 502. The height of the protruding base may be suitably designed in consideration of such a function.

The position in which said first connection portion 403 is located will be suitably determined taking into account positions of lands of the substrate, positions of patterns on the substrate, narrow spaces, and the like. Namely, the first connection portion 403 is positioned to face to the first contact portion 401 or to face to the first pressure receiving portion 406 according to the required specifications. Moreover, there may be a case that connection portions of adjacent contacts are staggered corresponding to positions of lands on a substrate. In the shown embodiment of the first contact 40, the first connection portion 403 is arranged on the side facing to the first pressure receiving portion 406. Said first contact portion 401 is in the form of a protrusion for the purpose of facilitating the contact with the flexible printed circuit board. The first connection portion 403 is of a surface mounting type (SMT) in the illustrated embodiment as shown in FIG. 5A. It may be of a dip type. In another case, a further first contact portion 401 is provided in opposition to said first contact portion 401 according to a specification of a flexible printed circuit board. In this case, the flexible printed circuit board is embraced between the two contact portions 401. In the illustrated embodiment, said first contact 40 comprises a first extension portion 407 extending from the first fulcrum portion 404 and facing to the first contact portion 401.

Said first fulcrum portion 404, said first elastic portion 405 and said first pressure receiving portion 406 serve as described in the following description when the flexible printed circuit board has been inserted into the connector 10. When the pivoting member 50 is being pivotally moved after the flexible printed circuit board has been inserted into the connector 10, the pushing portions 502 of the pivoting member 50 are rotated so as to act upon the first pressure receiving portions 406 of the first contacts 40, thereby causing the first pressure receiving portions 406 to be raised. Therefore, the first elastic portions 405 of said first contacts 40 are tilted toward the first contact portions 401 about the first fulcrum portions 404 of the first contacts 40 by the upward movement of the first pressure receiving portions 406, so that the first contact portions 401 are pushed against the flexible printed circuit board. Sizes and shapes of the first fulcrum portions 404, the first elastic portions 405 and the first pressure receiving portions 406 may be suitably designed so as to achieve these functions. The first pressure receiving portion 406 of the first contact 40 is preferably provided at one end with the projection as shown in the drawing. When the pushing portions 502 are caused to act on the first pressure receiving portions 406 of the first contacts 40, the first pressure receiving portions 406 enter the anchoring holes 503 of the pivoting member 50 and the projections of the first contacts 40 engage the anchoring holes 503, thereby withstanding the strong reaction force against the pivotal movement of the pivoting member 50. The size of the projection may be any one insofar as it can achieve the above function and is suitably designed to an extent such that the projection can be caught into the anchoring hole 503 of the pivoting member 50.

The second contact 42 will be explained hereafter. The differences of the second contact 42 from the first contact 40 only will be discussed below. The second contact 42 is substantially H-shaped as shown in FIG. 5B similar to the first contact 40 and mainly comprises a second contact portion 421 (positioned at the upper portion of the contact shown in FIG. 5B) adapted to contact the flexible printed circuit board, a second connection portion 423 to be connected to the substrate, a second fixed portion 422 to be fixed to the housing 30, a second fulcrum portion 424, a second elastic portion 425, and a second pressure receiving portion 426 adapted to be pushed by said pivoting member 50. Said second contact portion 421, said second elastic portion 425, said second fulcrum portion 424, and said second connection portion 423 are arranged substantially in the form of a U-shape. The second connection 423 is of a surface mounting type (SMT) similarly to that of the first contact. It may be of a dip type.

The main difference of the second contact 42 from the first contact 40 only lies in the construction that the second connection portion 423 and a second extension portion 427 are arranged in reversed positions although there are some differences in shape from those of the first contact. In other words, in the first contact 40, the first connection portion 403 faces to the first pressure receiving portion 406, and the first extension portion 407 faces to the first contact portion 401, and in the second contact 42, the second connection portion 423 faces to the second contact portion 421, and the second extension portion 427 faces to the second pressure receiving portion 426.

Figure 4A:
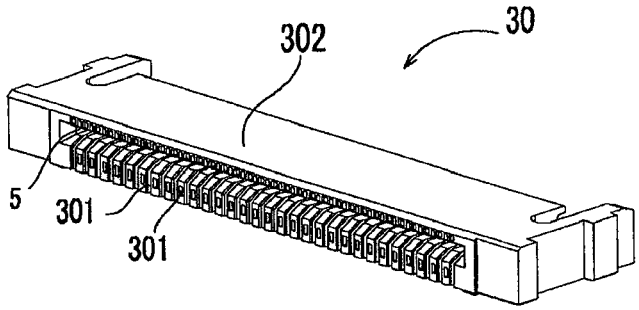
FIG. 4A is a perspective view of a housing shown in FIG. 1A viewed from its fitting opening.
Figure 4B:
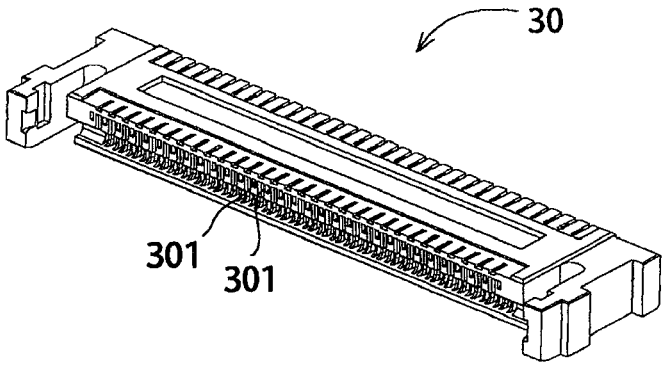
FIG. 4B is a perspective view of the housing shown in FIG. 4A viewed from the opposite side of the fitting opening.
Figure 4C:
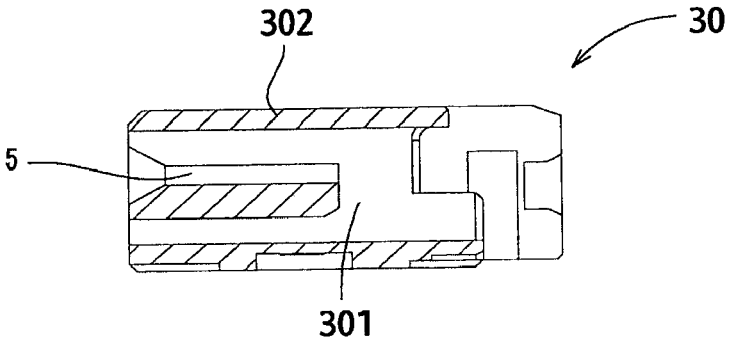
FIG. 4C is a cross-sectional view of the housing taken along one inserting groove for a contact.

The housing 30 will then be described referring to FIGS. 4A to 4C. The housing 30 is formed from an electrically insulating plastic material by means of the injection molding of the known technique. The materials for the housing 30 may be suitably selected in consideration of dimensional stability, workability, manufacturing cost, and the like, and such materials are generally polybutylene terephthalate (PBT), polyamide (66PA or 46PA), liquid crystal polymer (LCP), polycarbonate (PC), and the like and combination thereof.

Said housing 30 is formed with inserting grooves 301 into which a required number of the first and second contact 40 and 42 are inserted and fixed, respectively, by means of press-fitting, hooking (lancing), welding, or the like. The housing 30 is further formed with a fitting opening 5 into which the flexible printed circuit board is inserted. The size of the fitting opening 5 is suitably designed in a manner that the flexible printed circuit board can be inserted thereinto and after the flexible printed circuit board has been inserted therein, the pivoting member 50 is able to push the first and second contacts 40 and 42. The housing 30 is provided at both longitudinal ends with bearing portions for rotatably fitting therein the axles 505 of the pivoting member 50 to enable the pivotal movement of the pivoting member 50. As described above, the bearing portions have clearances in relation to the axles 505 received therein, thereby achieving a particular rotation (the position of the pivotal axis varies and is not fixed) of the pushing portions 502 of the pivoting member 50. The shape and size of the bearing portions may be any ones so long as the axles of the pivoting member 50 are received therein with clearness so as to allow the pivotal movement of the pivoting member 50 to achieve the particular rotation of the pushing portions 502 just described, and suitably designed in consideration of such functions, strength and size of the housing 30, and the like.

Moreover, said housing 30 is provided with a ceiling portion 302 for covering or insulating the first and second contact portions 401 and 421 of the first and second contacts 40 and 42. The ceiling portion 302 serves to improve the dust-proof ability of the housing for the first and second contacts 40 and 42. The size and shape of the ceiling portion may be suitably designed taking into account such a function, strength of the housing 30, pivotal movability and strength of the pivoting member 50, and the like. Thicknesses of walls of said housing 30 are made as thin as possible in consideration of the desired reduced overall height of the connector.

Figure 5A:
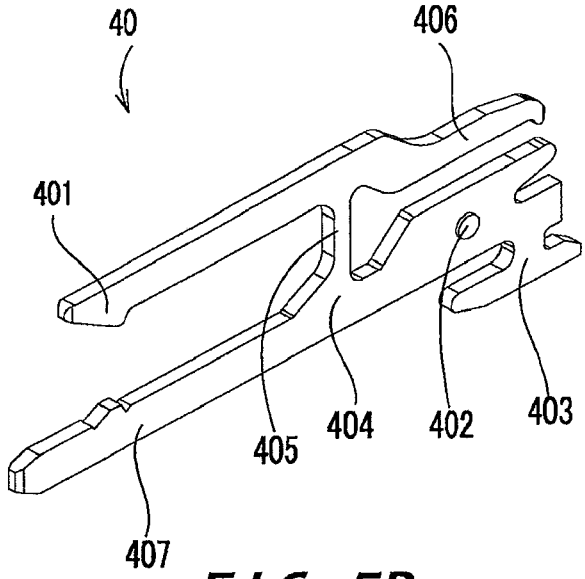
FIG. 5A is a perspective view of a first contact.
Figure 5B:
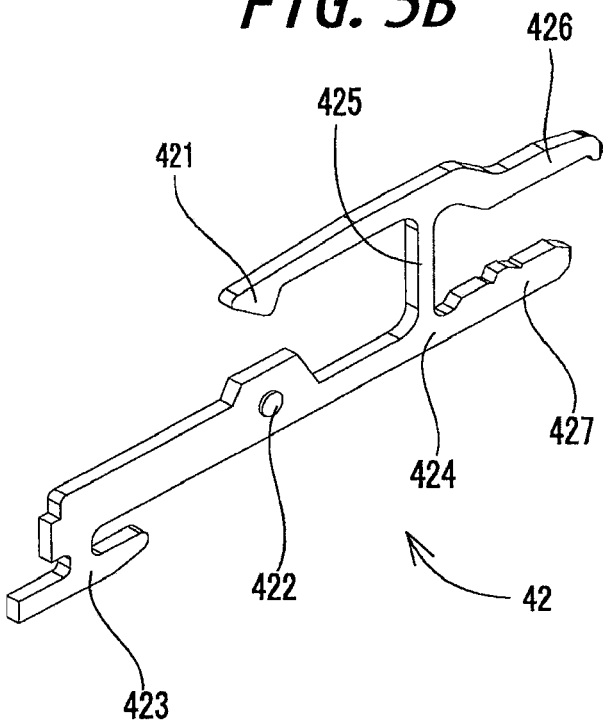
FIG. 5B is a perspective view of a second contact.
Figure 6A:
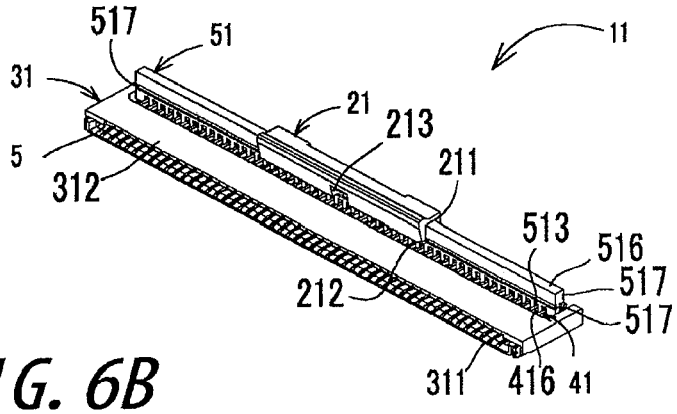
FIG. 6A is a perspective view of another connector according to the invention with an auxiliary member mounted on a pivoting member in an opened condition viewed from the above a fitting opening.
Figure 6B:
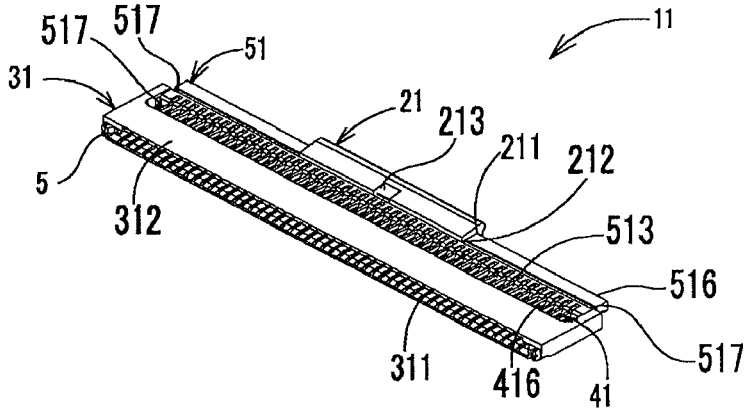
FIG. 6B is a perspective view of the connector shown in FIG. 6A with the auxiliary member mounted on the pivoting member in a closed condition viewed from the above the fitting opening.
Figure 6C:
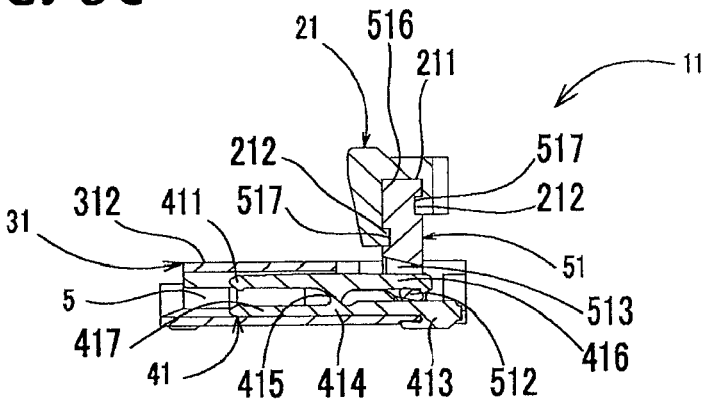
FIG. 6C is a sectional view of the connector under the condition shown in FIG. 6A taken along the center of the auxiliary member.
Figure 7A:
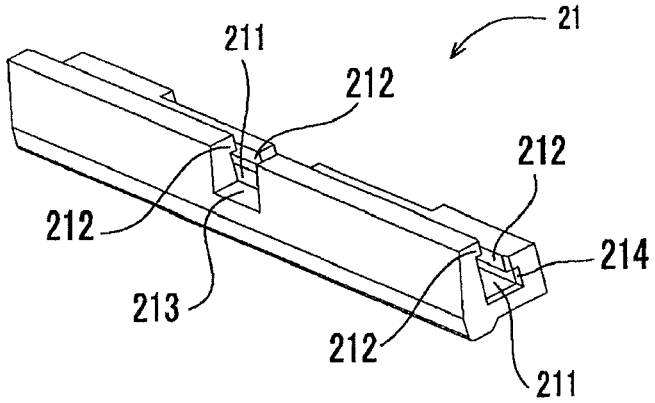
FIG. 7A is a perspective view of the auxiliary member shown in FIG. 6A viewed from the side on which it is attached to the pivoting member.
Figure 7B:
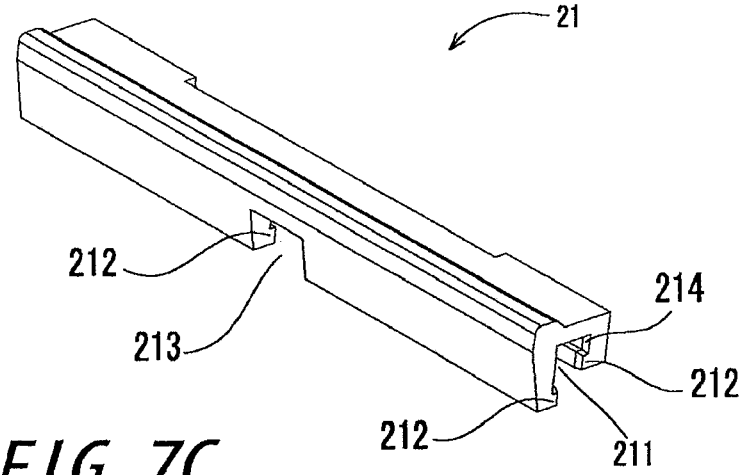
FIG. 7B is a perspective view of the auxiliary member shown in FIG. 7A viewed from the opposite side.
Figure 7C:
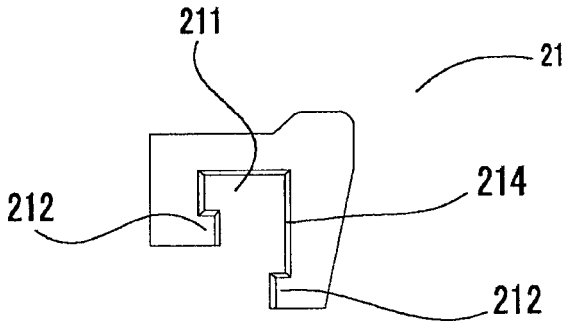
FIG. 7C is a cross-sectional view of the auxiliary member shown in FIG. 7B taken along its center.
Figure 8A:
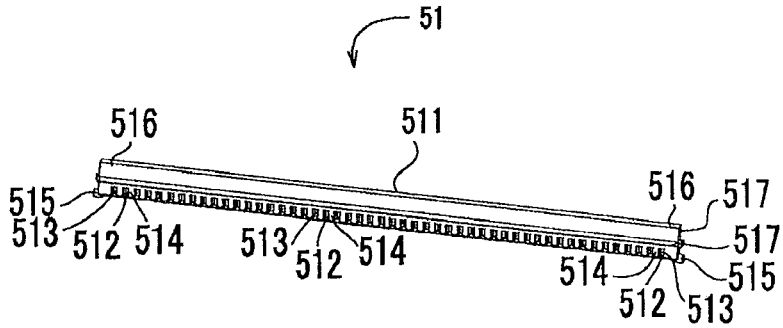
FIG. 8A is a perspective view of the pivoting member shown in FIG. 6A viewed from the fitting opening.
Figure 8B:
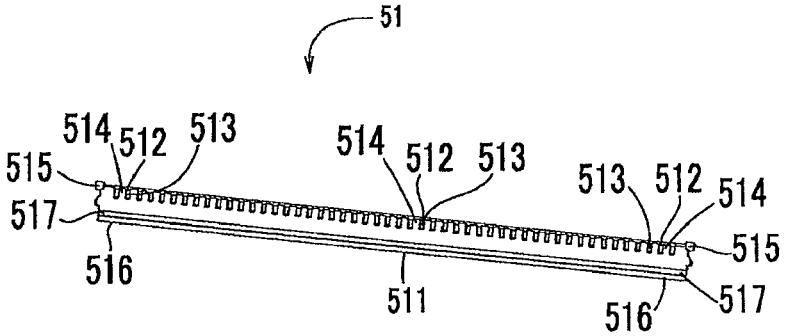
FIG. 8B is a perspective view of the pivoting member shown in FIG. 8A viewed from the opposite side of the fitting opening.
Figure 8C:
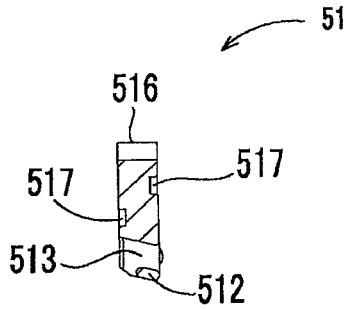
FIG. 8C is a cross-sectional view of the pivoting member shown in FIG. 8A.

Said first and second contacts 40 and 42 of the two kinds are shown substantially in the H-shapes as shown in FIGS. 5A and 5B. However, the first and second extension portions 407 and 427 may be removed from the first and second contacts 40 and 42 to form substantially h-shaped contacts.

In the first embodiment described above, two kinds of contacts are used for one connector. However, the connector may have only the first contacts or only the second contacts. In other words, the connector may have either kind of contacts of two kinds.

The connector 11 of the second embodiment will be explained with reference to FIGS. 6A to 10. The connector 11 mainly comprises a housing 31, a pivoting member 51, first contacts 41, and an auxiliary member 21. The connector 11 of the second embodiment achieves a more reduced overall height of the connector than that of the first embodiment. The auxiliary member 21 used in the second embodiment has early been described.

The components of the connector 11 will be explained with reference to FIGS. 6A to 10. First, the pivoting member 51 will be described. The pivoting member 51 is formed from an electrically insulating plastic material by means of the injection molding of the known technique. The materials for the pivoting member may be suitably selected in consideration of dimensional stability, workability, manufacturing cost, and the like, and such materials are generally polybutylene terephthalate (PBT), polyamide (66PA or 46PA), liquid crystal polymer (LCP), polycarbonate (PC), and the like and combination thereof.

Said pivoting member 51 mainly comprises axles 515 fitted in a housing 31 for pivotally moving the pivoting member 51, pushing portions 512 adapted to push first pressure receiving portions 416 of said first contacts 41, and anchoring holes 513 formed individually independently from one another defined by means of partitions 514 located between the anchoring holes for receiving therein first pressure receiving portions 416 of the first contacts 41. The axles 515 form a fulcrum of the pivotal movement of the pivoting member 51 and are rotatably supported in the longitudinal ends of the housing 31.

The pivoting member 51 is further provided at both the longitudinal ends thereof with locking portions adapted to engage the housing 31 for preventing the pivoting member 51 from being raised upwardly (in the upward direction viewed in the drawing) when the pushing portions 512 push the pressure receiving portions 416 of the first contacts 41. Shapes and sizes of the locking portions may be any ones so long as they are able to engage the housing 31, and are suitably designed in consideration of the above function, size and strength of the connector, and the like.

The pushing portions 512 of the pivoting member 51 serve to push the first pressure receiving portions 416 of the first contacts 41, and their shape is preferably an elongated shape, particularly elliptical in the illustrated embodiment. With such an elliptical shape, when the pivoting member 51 is pivotally moved so as to cause the pushing portions 512 to act on or push the first pressure receiving portions 416 of the first contacts 41, the pressure receiving portions 416 of the first contacts 41 are moved upwardly with the aid of variation in contact height owing to the elliptical shape of the pushing portions 512, thereby pushing the first contact portions 411 of the first contacts 41 against the flexible printed circuit board or flexible flat cable. The pushing portions 512 may be formed in any shape so long as they can be rotated so as to act on the first pressure receiving portions 416 of the first contacts 41, and the first pressure receiving portions 416 of the first contacts 41 can be raised with the aid of the variation in contact height owing to, for example, difference in major and minor axes of an ellipse.

When the pivoting member 51 is pivotally moved, the pivoting member 51 itself tends to be deformed at the middle by reaction forces against the pivotal movement. In order to prevent such a deformation, the pivoting member 51 is formed with anchoring holes 513 independent from one another defined by partitions 514 located between the anchoring holes 513. The anchoring holes 513 engage projections of the first contacts 41 to prevent the deformation of the pivoting member 51. The anchoring holes 513 provided independently from one another serve to maintain the strength of the pivoting member 51 and prevent it from being deformed when pivotally moving.

Said pivoting member 51 is provided with a ridge or tip 516 having a size received in a groove portion 211 of said auxiliary member 21. Said pivoting member 51 is further formed with a recessed portion 517 into which the protrusion 212 of the auxiliary member 21 is fitted. The ridge or tip 516 and the recessed portion 517 form means for mounting the auxiliary member 21 into engagement with the pivoting member 51. In this embodiment, the pivoting member 51 may have two recessed portions 517, but the pivoting member 51 may have just one recess portion 517. In this case, the auxiliary member may also have just one protrusion 212. Shapes and sizes of said ridge or tip 516 and said recessed portion 517 may be any ones insofar as the ridge or tip 516 is fitted in the groove portion 211 of the auxiliary member 21, and the recessed portions 517 receive the protrusions 212, and may be suitably designed in consideration of their functions, strength, workability, and the like. The recessed portions 517 linearly extend in the longitudinal direction of the pivoting member 51 in the illustrated embodiment, and may have a U-shaped or C-shaped cross-section insofar as their functions can be achieved.

Said pivoting member 51 is preferably provided at its center with a projection adapted to engage the recess 213 formed in said auxiliary member 21, thereby holding and positioning said auxiliary member 21. The shape and size of said projection may be any ones so long as it can engage the recess 213 of said auxiliary member 21 and suitably designed in consideration of the function, holding force, strength, workability, and the like.

Since the reaction forces against the pivotal movement of the pivoting member 51 are strong, the anchoring holes 513 adapted to receive therein the first pressure receiving portions 416 of the first contacts 41 are formed independently from one another in the pivoting member 51 by forming the partitions 514 between the anchoring holes 513. The anchoring holes 513 are provided independently from one another to maintain the strength of the pivoting member 51 with the aid of the partitions 514 and to prevent the deformation of the pivoting member 51 upon its pivotal movement. The pivoting member 51 described above is pivotally mounted on the housing 31 on the side opposite from its fitting opening 5, that is, on the same side as the first connection portions 413 of the first contacts 41.

Figure 10:
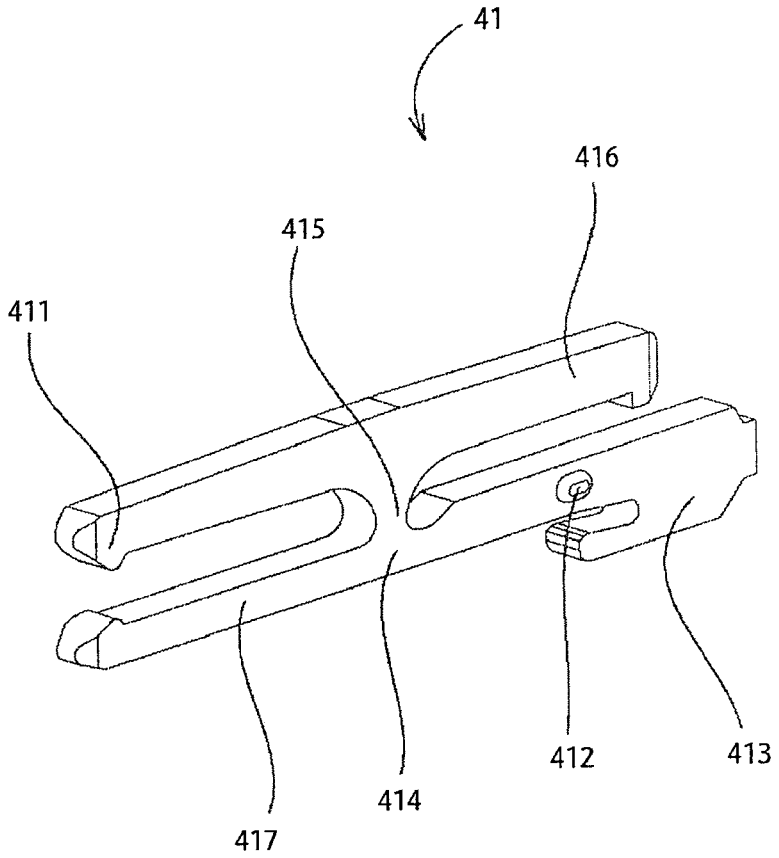
FIG. 10 is a perspective view of a first contact.
Figure 11A:
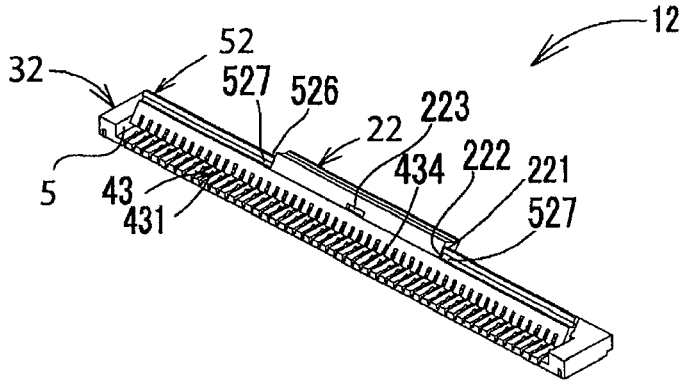
FIG. 11A is a perspective view of a further connector according to the invention with an auxiliary member mounted on a pivoting member in an opened condition viewed from the above a fitting opening.
Figure 11B:
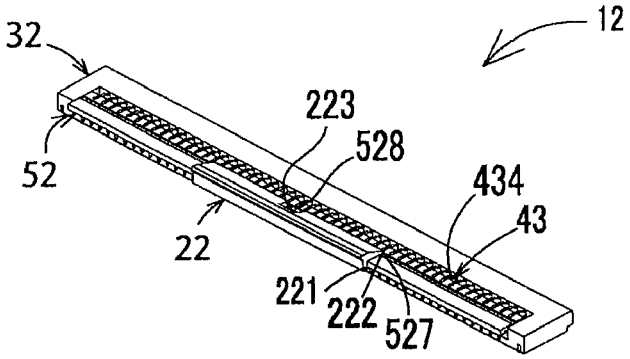
FIG. 11B is a perspective view of the connector shown in FIG. 11A with the auxiliary member mounted on the pivoting member in a closed condition viewed from the above the fitting opening.
Figure 11C:
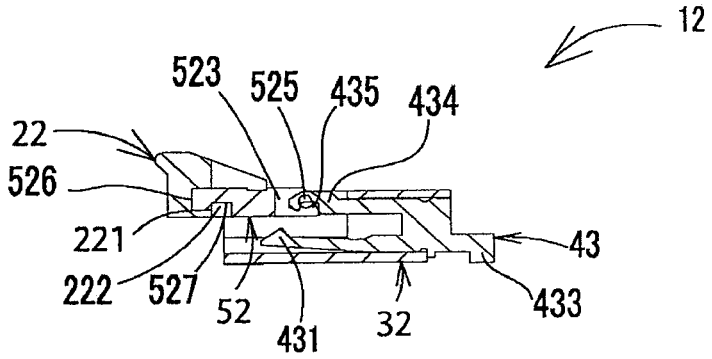
FIG. 11C is a cross-sectional view of the connector in the condition shown in FIG. 11B taken along its center.
Figure 12A:
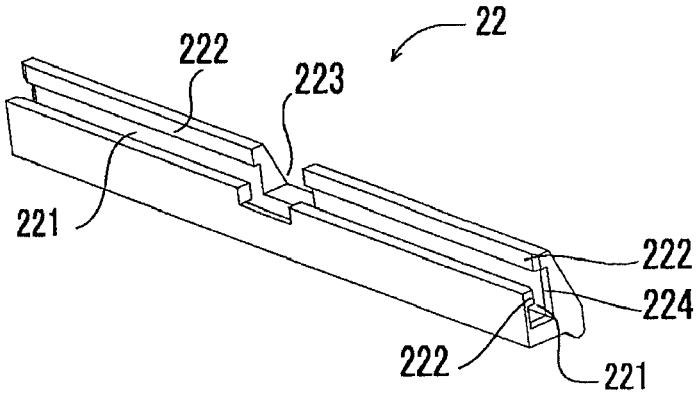
FIG. 12A is a perspective view of the auxiliary member shown in FIG. 11A viewed from the side on which it is attached to the pivoting member.
Figure 12B:
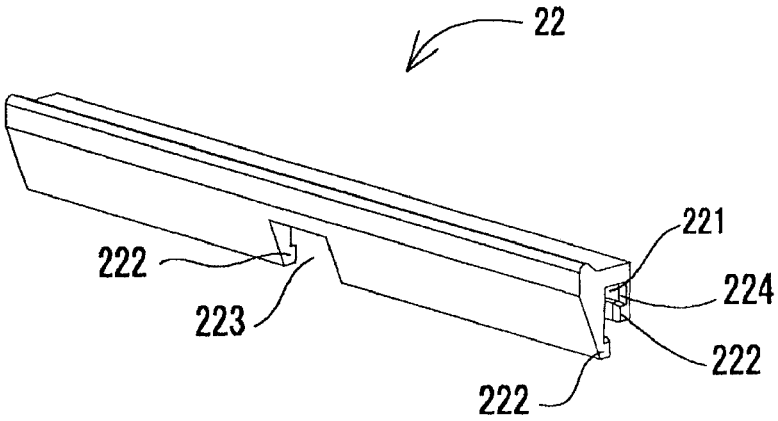
FIG. 12B is a perspective view of the auxiliary member shown in FIG. 12A viewed from the opposite side.
Figure 12C:
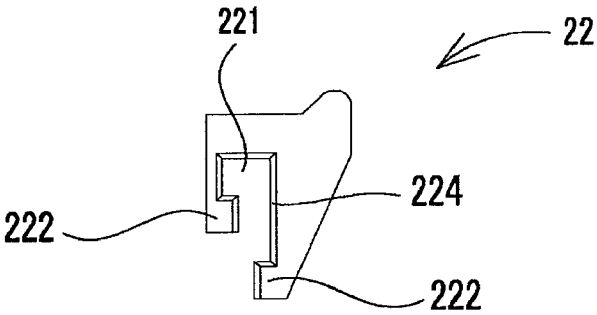
FIG. 12C is a cross-sectional view of the auxiliary member taken along its center.

The first contact 41 will then be described referring to FIG. 10. The first contacts 41 are made of a metal and formed by means of the press-working of the known technique. Preferred metals from which to form the first contacts 41 include brass, beryllium copper, phosphor bronze and the like which comply with the requirements as to springiness, electric conductivity, and the like.

Said contact 41 is substantially H-shaped as shown in FIG. 10, and mainly comprises a first contact portion 411 adapted to contact a flexible printed circuit board or flexible flat cable, a first connection portion 413 to be connected to a substrate, a first fixed portion 412 to be fixed to the housing 31, a first elastic portion 415 and a first fulcrum portion 414 arranged between said first contact portion 411 and said first connection portion 413, a first pressure receiving portion 416 extending from the first elastic portion 415 and positioned to face to the first connection portion 413, and a first extension portion 417 extending from said first fulcrum portion 414 in a manner facing to said first contact portion 411. The first contact 41 may be provided at the end of said first extension portion 417 with a further contact portion positioned to face to said first contact portion 411 and adapted to contact said flexible printed circuit board or flexible flat cable. Said first contact portion 411 on the upper side (positioned at upper portion in FIG. 10), said first elastic portion 415, said first fulcrum portion 414, and said first connection portion 413 are arranged substantially in the form of a crank. Said first contact portion 411 has a protrusion shape to ensure the contact with the flexible printed circuit board or flexible flat cable. The first connection portion 413 is of a surface mounting type (SMT) as shown in FIG. 10 in this embodiment. It may be of a dip type. In the case having two contact portions, the two contact portions are arranged to face to each other so that the inserted flexible printed circuit board or flexible flat cable is embraced by the two contact portions to ensure electrical contact therebetween.

Said first fulcrum portion 414, said first elastic portion 415, and said first pressure receiving portion 416 serve to perform the following functions described below when the flexible printed circuit board or flexible flat cable has been inserted into the connector 11. When the pivoting member 51 is being pivotally moved after the flexible printed circuit board has been inserted into the fitting opening 5 of the connector 11, the pushing portions 512 of the pivoting member 51 are rotated so as to act upon the first pressure receiving portions 416 of said first contacts 41, thereby causing the first pressure receiving portions 416 to be raised. As a result, the first elastic portions 415 of the first contacts 41 are tilted toward the first contact portions 411 about the first fulcrum portions 414 of the first contacts 41 by the upward movement of the first pressure receiving portions 416 so that the first contact portions 411 are securely pushed to the flexible printed circuit board or flexible flat cable. The sizes and shapes of said first fulcrum portions 414, said first elastic portions 415, and said first pressure receiving portions 416 may be suitably designed so as to achieve these functions.

Moreover, the first pressure receiving portion 416 of the first contact 41 is preferably provided at one end with a projection, thereby preventing the center of the pivoting member 51 from being outwardly deformed owing to the strong reaction force against the pivotal movement of the pivoting member 51 with its pushing portions 512 acting upon the first pressure receiving portions 416 of the first contacts 41. The size of the projections of the first contacts 41 may be any one insofar as they can achieve the above function and is suitably designed to an extent such that the pushing portions 512 of the pivoting member 51 easily engage the projections of the first contacts 41.

A further contact different from the first contact 41 shown in FIG. 10 will be explained. The differences from the first contact 41 only will be described below. Such a contact does not have the first extension portion 417 extending from the first fulcrum portion 414 and facing to the first contact portion 411, thereby forming an h-shaped contact.

Finally, a housing 31 will be described referring to FIGS. 9A to 9C. The housing is formed from an electrically insulating plastic material by means of the injection molding of the known technique. The materials for the housing may be suitably selected in consideration of dimensional stability, workability, manufacturing cost, and the like, and such materials are generally polybutylene terephthalate (PBT), polyamide (66PA or 46PA), liquid crystal polymer (LCP), polycarbonate (PC), and the like and combination thereof.

Figure 9A:
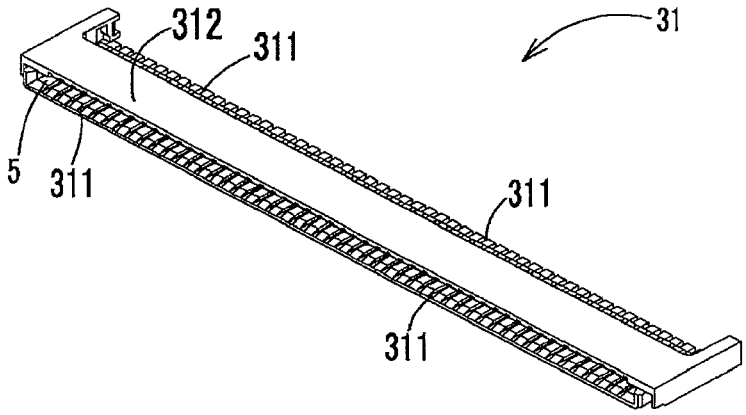
FIG. 9A is a perspective view of the housing shown in FIG. 6A viewed from the fitting opening.
Figure 9B:
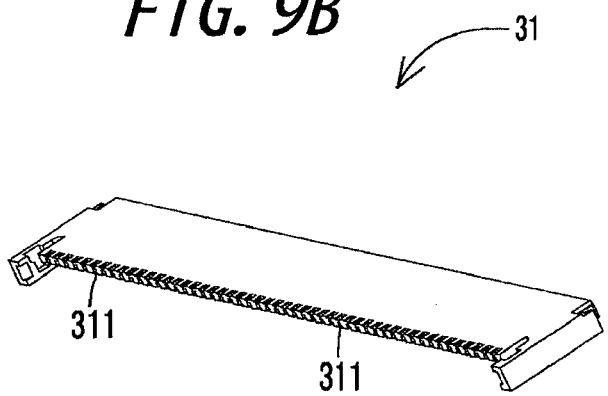
FIG. 9B is a perspective view of the housing shown in FIG. 9A viewed from opposite side of the fitting opening.
Figure 9C:
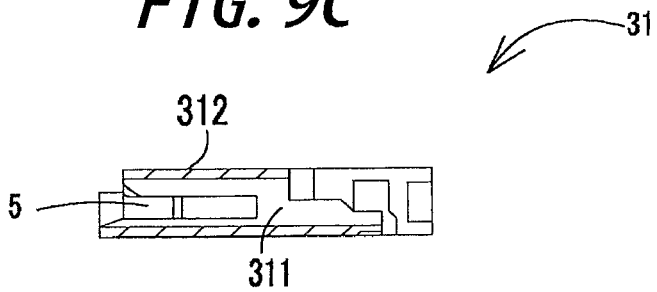
FIG. 9C is a cross-sectional view of the housing shown in FIG. 9A taken along one inserting groove for a contact.

As shown in FIGS. 9A to 9C, the housing 31 is formed with inserting grooves 311 into which a required number of the first contacts 41 are inserted and fixed, respectively, by means of press-fitting, hooking (lancing), welding, or the like. The housing 31 is provided at both the longitudinal ends with bearing portions for rotatably fitting therein the axles 515 of the pivoting member 51, thereby enabling the pivoting member 51 to be pivotally moved relative to the housing 31. Shapes and sizes of the bearing portions may be any ones so long as the pivoting member 51 can be pivotally moved about the axles, and be suitably designed in consideration of such functions, strength and size of the housing 31, and the like. Moreover, the housing 31 is provided on both the longitudinal ends with anchoring portions at locations corresponding to the locking portions of the pivoting member 51.

The housing 31 is further provided with a ceiling portion 312 for covering or insulating the first contact portions 411 of the first contacts 41. The ceiling portion 312 serves to improve the dust-proof ability of the housing for the first contacts 41. The size and shape of the ceiling portion may be suitably designed taking into account such a function, strength of said housing 31, pivotal movability and strength of the pivoting member 51, and the like. Thicknesses of walls of said housing 31 are made as thin as possible in consideration of the desired reduced overall height of the connector.

In this second embodiment, said first contacts 41 of one kind only are used for one connector. However, the connector may have two kinds of contacts as is the case with the first embodiment or may have contacts of a kind other than the first contacts 41. In other words, the connector may have only either kind of contacts of two kinds. (The connector may have either kind or both kinds of contacts.)

A connector 12 of the front lock type according to the third embodiment will be described with reference to FIGS. 11A to 15. The connector 12 mainly comprises a housing 32, a pivoting member 52, first contacts 43, and the auxiliary member 22. The construction of the auxiliary member 22 used in the third embodiment has been early described. Therefore, a plurality of contacts 43, the housing 32, and the pivoting member 52 will be described for the connector 12.

Figure 13A:
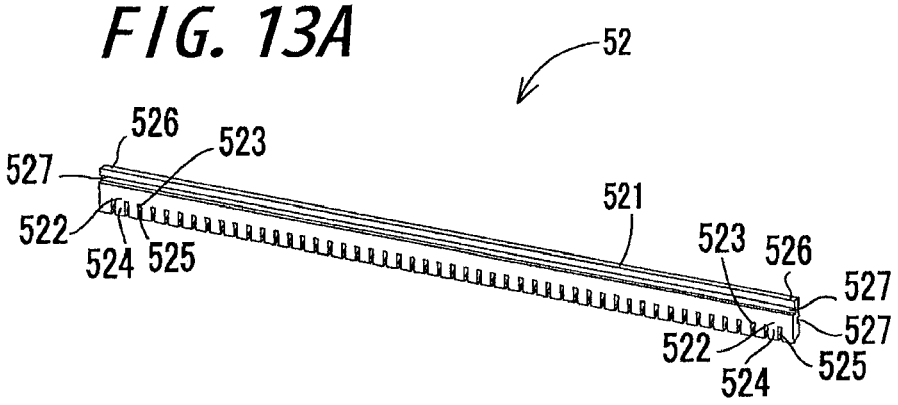
FIG. 13A is a perspective view of the pivoting member shown in FIG. 11A viewed from the fitting opening.
Figure 13B:
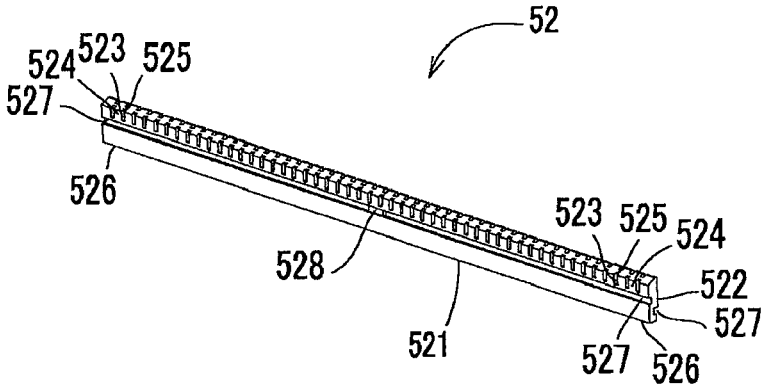
FIG. 13B is a perspective view of the pivoting member shown in FIG. 13A viewed from the opposite side.
Figure 13C:
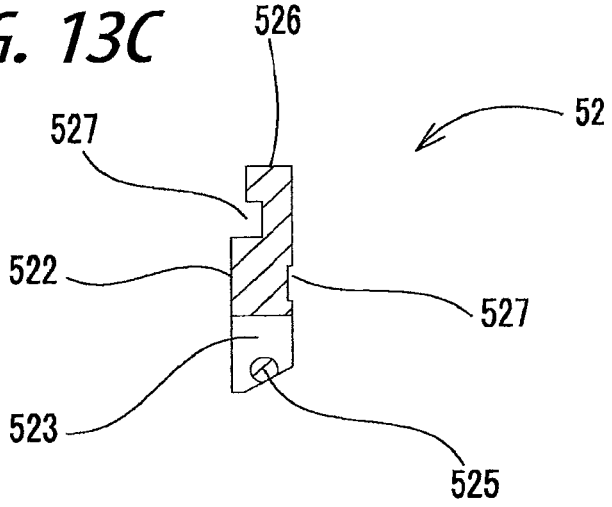
FIG. 13C is a cross-sectional view of the pivoting member shown in FIG. 13A.

First, the pivoting member 52 will be described with reference to FIGS. 13A to 13C. The pivoting member 52 is formed from an electrically insulating plastic material by means of the injection molding of the known technique. The materials for the pivoting member may be suitably selected in consideration of dimensional stability, workability, manufacturing cost, and the like, and such materials are generally polybutylene terephthalate (PBT), polyamide (66PA or 46PA), liquid crystal polymer (LCP), polycarbonate (PC), and the like and combination thereof. Said pivoting member 52 mainly comprises axles 525 adapted to rotatably engage said contacts 43, respectively, a pushing portion or pushing portions 522 for pushing a flexible printed circuit board or flexible flat cable against contact portions 431 of said contacts 43, anchoring holes 523 formed independent from one another by partitions 524 between the anchoring holes for receiving therein engaging portions 434 of said contacts 43, respectively, a ridge or tip 526 adapted to be fitted in the groove portion 221 of said auxiliary member 22, and recessed portions 527 for receiving the protrusions 222 of the auxiliary member 22.

Said axles 525 form a fulcrum for pivoting the pivoting member 52 and are suitably engage or fitted in recesses 435 of engaging portions 434 of said contacts 43 in this embodiment. However, the pivoting member 52 may be provided at both the longitudinal ends with axles (not shown) adapted to be fitted in bearing portions provided in the both longitudinal ends of the housing 32 as is the case with the embodiments previously described. The pivoting member is further provided at both the longitudinal ends with locking portions adapted to engage the housing 32 in order to prevent the pivoting member 52 from being raised (in upper direction viewed in the drawing) when the flexible printed circuit board or flexible flat cable is pushed against said contacts 43. The shape and size of the locking portions may be any ones so long as they can engage said housing 32 and are suitably designed in consideration of the function, size and strength of the connector 12, and the like.

Said pushing portion or portions 522 serve to push the flexible printed circuit board or flexible flat cable against the contact portions 431 of said contacts 43 and form a flat surface in this embodiment. As the case may be, instead of the pushing portion 522 said axles 525 may be formed in an elliptical shape so that the flexible printed circuit board or flexible flat cable is pushed against the contact portions 431 of the contacts 43 with the aid of variation in contact height owing to differences in major and minor axes of the ellipse as is the case with the previously described embodiments. The shape and size of said pushing portion or portions 522 may be any ones insofar as it can push the flexible printed circuit board or flexible flat cable against the contact portions 431 of the contacts 43 and may be suitably designed taking into account its function, strength, workability, and the like.

Said pivoting member 52 is provided with anchoring holes 523 formed independently from one another by partitions 524 located between the anchoring holes 523 and adapted to engage engaging portions 434 of the contacts 43. Said anchoring holes 523 engage the engaging portions 434 of the contacts 43 to achieve the stable pivotal movement of the pivoting member 52, at the same time to prevent the central part of the pivoting member 52 from being outwardly deformed due to a strong reaction force against the pivotal movement of the pivoting member 52 upon being pivoted. The anchoring holes 523 are formed independently from one another to maintain the strength of the pivoting member 52 with the aid of the partitions 524 located between the anchoring holes 523 and to prevent the deformation of the pivoting member 52 when being pivoted.

Said pivoting member 52 is provided with a ridge or tip 526 having a size to be received in the groove portion 221 of the auxiliary member 22 and is formed with recessed portions 527 into which the protrusions 222 of the auxiliary member 22 are fitted. Said ridge or tip 526 and recessed portions 527 are means for causing the auxiliary member 22 to engage the pivoting member 52. In this embodiment, the pivoting member 52 has the two recessed portions 527 one on each side of it as shown in the drawing, but the pivoting member 52 may have only one recessed portion 527. In this case, the auxiliary member also has only one protrusion 222. The shapes and sizes of said ridge or tip 526 and said recessed portions 527 may be any ones so long as the ridge 526 is fitted in the groove portion 221 of the auxiliary member 22 and the recessed portions 527 receive the protrusions 222, and may be suitably designed taking into account their functions, strength, workability, and the like. The recessed portions 527 extend linearly in the longitudinal direction of the pivoting member 52 in the illustrated embodiment, and may have a U-shaped or C-shaped cross-section insofar as their functions can be achieved.

Said pivoting member 52 is further provided substantially at its center with a projection 528 adapted to engage the recess 223 of said auxiliary member 22, thereby holding and positioning the auxiliary member 22 relatively to the pivoting member 52. The shape and size of the projection 528 may be any ones insofar as it can engage the recess 223 of the auxiliary member 22 and suitably designed taking into account the function, holding force, strength, workability, and the like.

The contacts 43 will then be described with reference to FIG. 15. The contacts 43 are made of a metal and formed by means of the press-working of the known technique. Preferred metals from which to form the contacts 43 include brass, beryllium copper, phosphor bronze and like which comply with the requirements as to springiness, electric conductivity, and the like. Said contact 43 is substantially U-shaped as shown in FIG. 15 and mainly comprises a contact portion 431 adapted to contact a flexible printed circuit board or flexible flat cable, a connection portion 433 to be connected to a substrate, a fixed portion 432 to be fixed to the housing 32, and an engaging portion 434 to be engaged with said pivoting member 52.

Said contact portion 431 is in the form of a protrusion for facilitating the contact with the flexible printed circuit board or flexible flat cable. The connection portion 433 is of a surface mounting type (SMT) in the illustrated embodiment as shown in FIG. 15. It may be of a dip type. Said fixed portion 432 is in the form of an arrowhead and fixed in the housing 32 by means of press-fitting.

Figure 15:
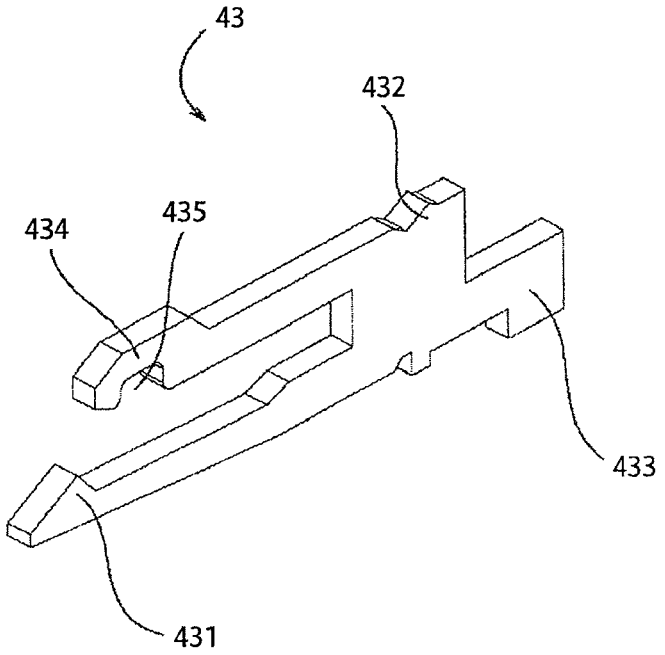
FIG. 15 is a perspective view of a contact used in the connector shown in FIG. 11A.

Said engaging portion 434 of the contact 43 is formed with a recess 435 as shown in FIG. 15. The axles 525 of the pivoting member 52 are received and engaged in the recesses 435 of the contacts 43 arranged in the housing 32. The shapes and sizes of said engaging portion 434 and said recess 435 are suitably designed in consideration of such functions, contact stability, workability, strength, and the like. Moreover, the engaging portion 434 may be removed from the contact 43, and there may be provided a member or members separate from the contacts 43 and each having an engaging portion 434 adapted to engage the pivoting member 52.

Figure 14A:
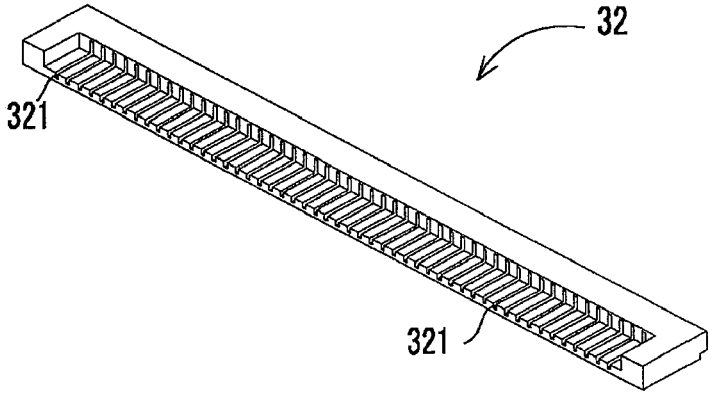
FIG. 14A is a perspective view of the housing shown in FIG. 11A viewed from the fitting opening.
Figure 14B:
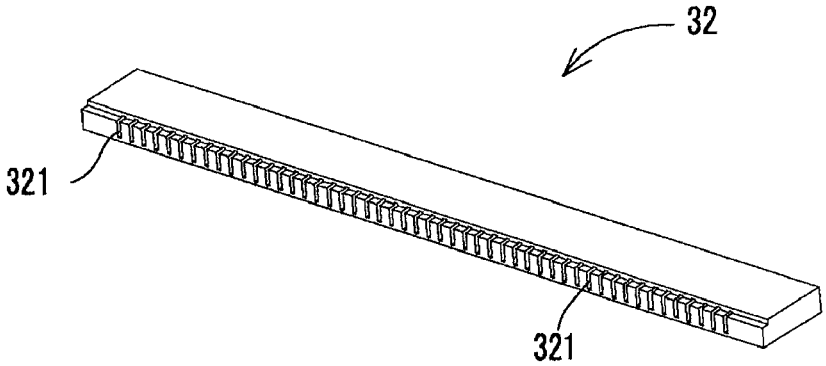
FIG. 14B is a perspective view of the housing shown in FIG. 11A viewed from the opposite side.
Figure 14C:
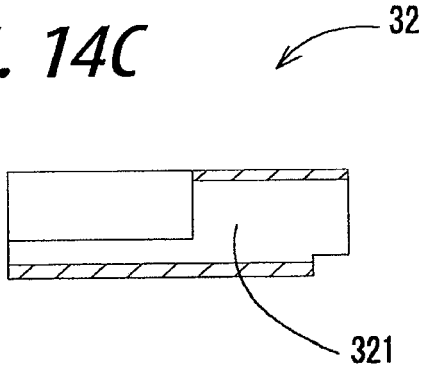
FIG. 14C is a cross-sectional view of the housing shown in FIG. 14A taken along one inserting groove for a contact.

Finally, the housing or block 32 will be described referring to FIGS. 14A to 14C. The housing or block 32 is formed from an electrically insulating plastic material by means of the injection molding of the known technique. The materials for the housing or block 32 may be suitably selected in consideration of dimensional stability, workability, manufacturing cost, and the like, and such materials are generally polybutylene terephthalate (PBT), polyamide (66PA or 46PA), liquid crystal polymer (LCP), polycarbonate (PC), and the like and combination thereof. The housing or block 32 is formed with inserting grooves 321 into which a required number of the contacts 43 are inserted and fixed, respectively, by means of press-fitting, welding, and the like. Moreover, it may be desired to provide anchoring portions on both the longitudinal ends of the housing or block 32 at locations corresponding to the locking portions of said pivoting member 52.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector to be detachably fitted with a connecting object, said connector including:

a plurality of contacts each having a contact portion adapted to contact said connecting object, a housing arranging and holding therein said contacts and having a fitting opening into which said connecting object is inserted, and a pivoting member rotatably mounted about an axis of rotation on said housing, wherein said pivoting member has first and second longitudinal ends and extends in a first direction which is essentially parallel to said axis of rotation, and which is essentially parallel to the connecting object when the connecting object is contacted by the contact portions and fitted to the connector, wherein said pivoting member has a length, in said first direction, from said first longitudinal end to said second longitudinal end, wherein said pivoting member has a ridge that extends in the first direction, and wherein an auxiliary member is mounted on said pivoting member at a predetermined position, said auxiliary member having engaging means for engaging said pivoting member, and wherein the auxiliary member extends in said first direction and has first and second longitudinal ends, and wherein said auxiliary member has a length, in said first direction, from said first longitudinal end of said auxiliary member to said second longitudinal end of said auxiliary member, and wherein said length of said auxiliary member in said first direction is less than said length of the pivoting member in said first direction;

wherein said engaging means comprises an engaging portion provided on said auxiliary member and an anchoring portion provided on said pivoting member; and wherein said anchoring portion comprises a recessed portion formed in said pivoting member, and said engaging portion comprises a protrusion formed in said auxiliary member and adapted to be fitted in said recessed portion of said pivoting member and a groove portion formed in said auxiliary member and adapted to receive the ridge of said pivoting member.

2. The connector as claimed in claim 1, wherein said auxiliary member is provided with a guide at least at one longitudinal end of said protrusion and said groove portion.

3. The connector as claimed in claim 1, wherein said pivoting member is rotatably mounted on said housing on an opposite side viewed from said fitting opening, and wherein said contacts include at least one kind of contacts selected from two kinds of contacts, said two kinds of contacts comprising: a first kind of contacts each comprising at least a first contact portion, a first connection portion, a first elastic portion and a first fulcrum portion between said first contact portion and said first connection portion, and a first pressure receiving portion extending from said first elastic portion in a position facing to said first connection portion, and said first contact portion, said first elastic portion, said first fulcrum portion, and said connection portion being arranged in the form of a crank, and a second kind of contacts each comprising at least a second contact portion, a second connection portion, a second elastic portion and a second fulcrum portion between said second contact portion and said second connection portion, and a second pressure receiving portion extending from said second elastic portion in a direction opposite from said second contact portion, and said second contact portion, said second elastic portion, said second fulcrum portion, and said second connection portion being arranged in the form of a U-shape.

4. The connector as claimed in claim 3, wherein said pivoting member is rotatably mounted on said housing on the side opposite from said fitting opening, and wherein said pivoting member is provided with pushing portions of an elongated shape continuously arranged in the longitudinal direction of the pivoting member and adapted to act on said first pressure receiving portions and/or said second pressure receiving portions, and said pivoting member is further provided with anchoring holes independent from one another having partitions to permit said first pressure receiving portions and/or said second pressure receiving portions to be received in said anchoring holes, thereby connecting the connector to said connecting object by the action of the pushing portions on said first pressure receiving portions and/or said second pressure receiving portions.

5. The connector as claimed in claim 1, wherein said pivoting member is rotatably mounted on said housing on a side of said fitting opening, wherein said contacts each comprise at least a contact portion adapted to contact said connecting object, a connection portion to be connected to a substrate, a fixed portion to be fixed in said housing, and an engaging portion to engage said pivoting member, and wherein said pivoting member is provided with pushing portions continuously arranged in the longitudinal direction of the pivoting member and anchoring holes independent from one another having partitions to permit said engaging portions to be received in said anchoring holes, whereby when said engaging portions engage said anchoring holes and said pivoting member is pivotally moved, said pushing portions push said connecting object to bring it into contact with said contact portions of said contacts.

6. The connector as claimed in claim 1, wherein said pivoting member is rotatably mounted on said housing on a side of said fitting opening, wherein said contacts each comprise at least a contact portion adapted to contact said connecting object, and a connection portion to be connected to a substrate, wherein a member separate from said contact is provided, which has at least an engaging portion adapted to engage said pivoting member, and wherein said pivoting member is provided with pushing portions continuously arranged in the longitudinal direction of the pivoting member and anchoring holes independent from one another having partitions to permit said engaging portion as to be received in said anchoring holes, whereby when said engaging portions engage said anchoring holes and said pivoting member is pivotally moved, said pushing portions push said connecting object to bring it into contact with said contact portions of said contacts.

* * * * *